US006895613B1

(12) United States Patent
Clouston

(10) Patent No.: US 6,895,613 B1
(45) Date of Patent: May 24, 2005

(54) GROUND COVER ANCHOR

(76) Inventor: Alan R. Clouston, 1740 Tomlinson Common, Edmonton, Alberta (CA), T6R 2W6

( * ) Notice: Subject to any disclaimer, the term of this patent is extended or adjusted under 35 U.S.C. 154(b) by 0 days.

(21) Appl. No.: 10/700,534

(22) Filed: Nov. 5, 2003

(51) Int. Cl.[7] ..... F16M 13/00; E94H 15/62
(52) U.S. Cl. ..... 5/417; 135/118; 248/545
(58) Field of Search ..... 5/417; 135/118; 52/3, 155, 157; 248/545

(56) References Cited

U.S. PATENT DOCUMENTS 4,258,514 A * 3/1981 St. Clair ..... 52/86
5,327,922 A * 7/1994 Deroche ..... 135/118
5,396,743 A * 3/1995 Bellette ..... 52/154
5,457,918 A 10/1995 Plourde
5,713,383 A * 2/1998 Ramirez et al. ..... 135/118
5,832,672 A * 11/1998 Griffiths et al. ..... 52/4
6,226,813 B1 * 5/2001 Wilburn et al. ..... 5/417
6,256,942 B1 * 7/2001 Schatz ..... 52/155
6,272,798 B1 * 8/2001 Cockman ..... 52/155
6,631,527 B2 * 10/2003 Hyduk ..... 5/417

FOREIGN PATENT DOCUMENTS

CA 2143059 8/1996

* cited by examiner

*Primary Examiner*—Michael Trettel

(57) ABSTRACT

A ground cover anchor for securing a ground cover such as a beach towel or a blanket in sand or other types of ground. The ground cover anchor comprises a shaft, with one end for inserting into the ground, and the other end comprising a clamp for securing the ground cover to the anchor. The end for inserting into the ground my comprise barbs, an inverted cone, or a spiral to increase the hold in the ground. The clamp may comprise two lengths held together by a nut, elastic properties, or other means to secure the ground cover.

16 Claims, 4 Drawing Sheets

GROUND COVER ANCHOR

BACKGROUND OF THE INVENTION

In recreational settings, ground covers, such as beach towels or picnic blankets, are used for cleanliness and comfort. However, wind may cause these ground covers to move. Users are required to anchor their beach towels or blankets with heavy objects. This invention is intended to provide a means of anchoring a ground cover.

SUMMARY OF THE INVENTION

There is therefore provided, according to an aspect of the invention, a ground cover anchor for anchoring a ground cover, the ground cover anchor comprising a shaft, the shaft having one end for inserting into the ground; a clamp on the other end of the shaft for securing the ground cover; and means for staying the clamp on the ground cover. The shaft may comprise barbs at the end for inserting into the ground, an inverted cone at the end for inserting into the ground, or a spiral, the spiral being suitable for screwing into the ground. The shaft may comprise a smooth surface between the barbs and the clamp, the surface being suitable for printing on. The ground cover may be a towel or a blanket. The anchor may be inserted into sand.

According to a further aspect of the invention, the clamp comprises an upper length and a lower length, the upper length and lower length oriented perpendicular to the shaft, the upper and lower lengths being attached to the shaft at one end, and the other ends being disposed to receive the ground cover such that the ground cover is secured. The ground cover may be secured by teeth on the inside of each length, or by a series of ridges on the inside one length and a series of ridges on the inside of the other length staggered in relation to the ridges on the inside of one length. The means for staying the clamp may comprise the bottom length being attached immovably to the shaft, the top length being free to move along the shaft between the bottom length and a nut, which may be a wingnut, the shaft comprising threads above the bottom length, and the nut holding the top length and the bottom length together when moved down the shaft. The means for staying the clamp may comprise a protrusion from one length and a hole corresponding to the size and position of the protrusion such that when the hole receives the protrusion, the lengths are oriented along each other. A stop is attached to the top of the shaft such that the nut cannot be removed from the shaft. The lengths may be attached to the shaft and are held together by elastic means such that the lengths can be separated, the ground cover inserted, and the lengths will secure the ground cover when released.

According to a further aspect of the invention, the ground cover anchor may be plastic. The ground cover anchor may be brightly colored so as to be easily located.

According to a further aspect of the invention, a method of anchoring a ground cover using the ground cover anchor of the invention.

These and other aspect of the invention will become apparent from the description below.

BRIEF DESCRIPTION OF THE DRAWINGS

There will now be given a description of the drawings, by way of illustration only and not with the intent of limiting the invention, where like reference characters denote like elements, and where.

DETAILED DESCRIPTION OF THE INVENTION

Figure 1:
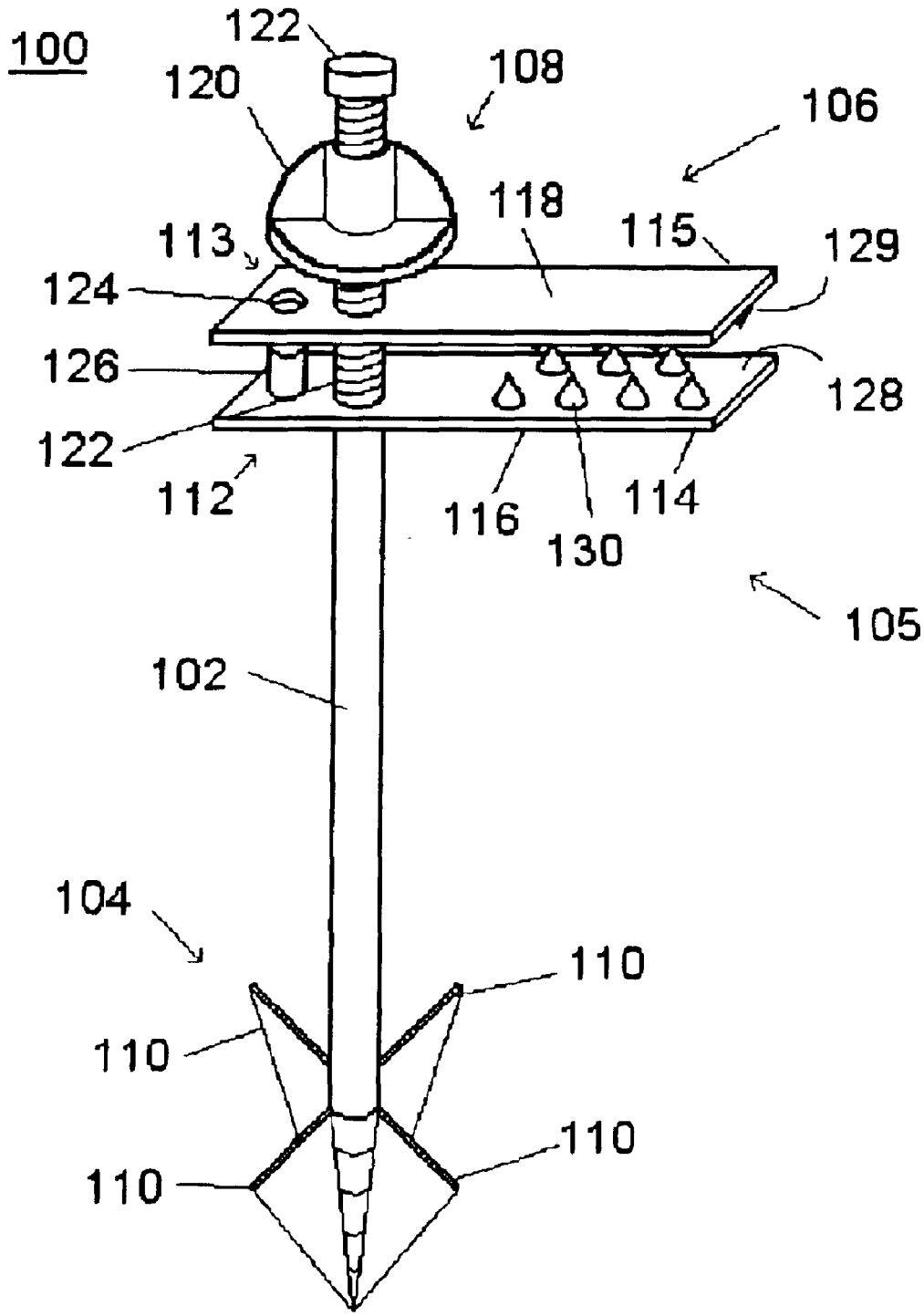
FIG. 1 depicts a ground cover anchor according to an embodiment of the invention.
Figure 2:
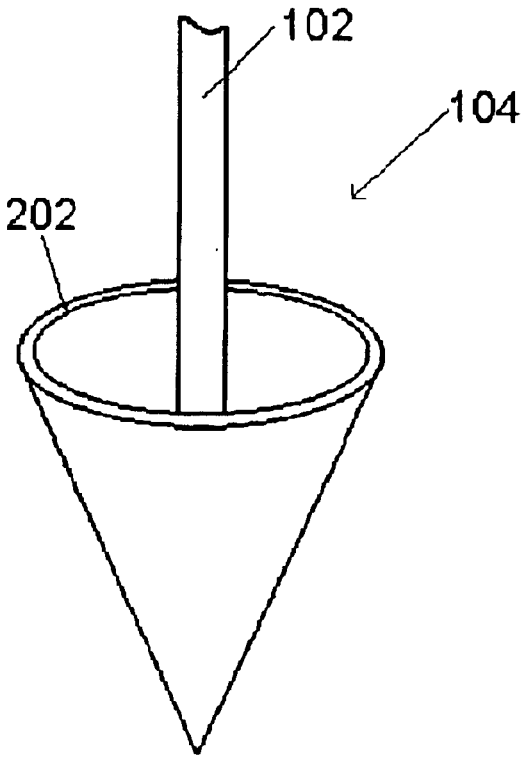
FIG. 2 depicts an anchoring means.
Figure 3:
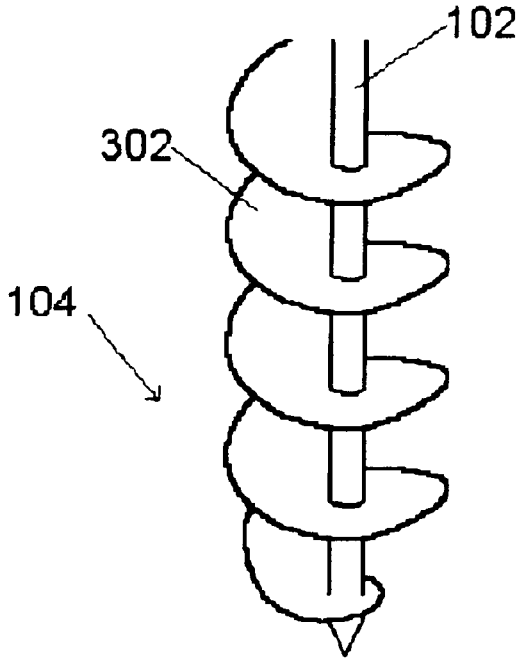
FIG. 3 depicts another anchoring means.

Referring now to FIG. 1, there is shown a ground cover anchor or peg 100, which may be used for anchoring a beach towel, picnic blanket, mat, or other ground cover. The ground cover anchor 100 is comprised of a shaft 102, the shaft having one end 104 for inserting into the ground and a clamp 106 on the other end 105 for attaching to the ground cover. The anchor 100 also comprises means for staying the clamp on the ground cover 108. To provide more stability to the anchor, especially if used in sand for a beach towel or mat, the anchor may also comprise barbs 110. FIG. 2 depicts the end 104 for inserting in the ground comprising an inverted cone 202 such that, when the end 104 is inserted into sand, the cone 202 fills with sand, and provides more resistance to being removed. Another option is a spiral 302 down the length of the shaft 102 as shown in FIG. 3. The advantage of employing barbs 110 or an inverted cone 202 is that the shaft 102 can be made smooth and suitable for printed advertising, such as a store logo.

Figure 5A:
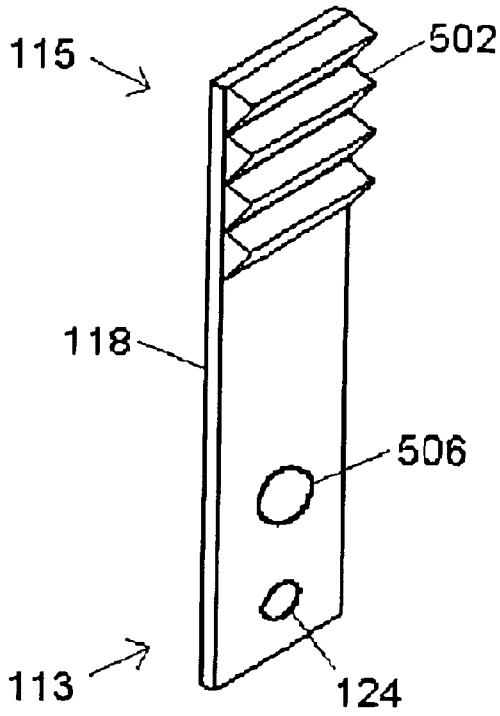
FIG. 5*a* depicts a top length of a clamp.
Figure 5B:
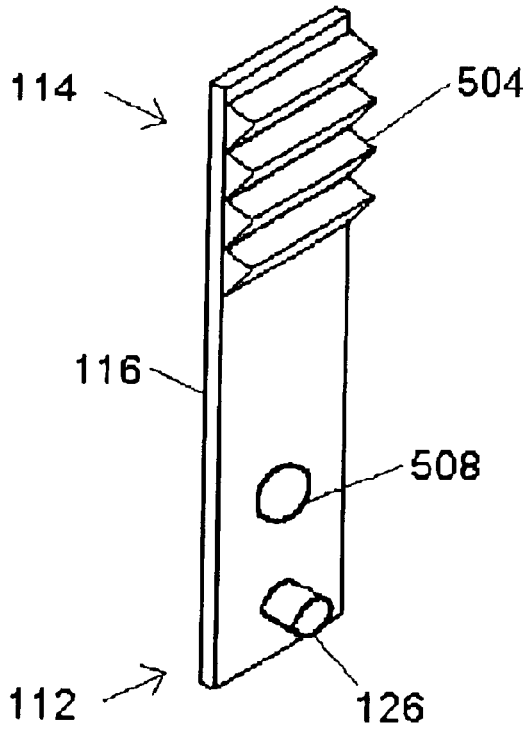
FIG. 5*b* depicts a bottom length of a clamp.

Referring again to FIG. 1, the clamp 106 will now be discussed in more detail. Two lengths, an upper length 118 and a lower length 116, are oriented perpendicular to the shaft 102, with one end 112 and 113 of each length attached to the shaft 102, such that the ground cover can be received between the other ends 114 and 115, and secured. This may be accomplished by having the lower length 116 fixed to the shaft 102, while the upper length 118 is free to move along the shaft 102. Above the upper length 108 is a nut 120, such as a wingnut that can be finger-tightened and loosened, that engages threads 122 along the shaft 102. There may also be a stop 122 attached to the top of the shaft 102 to prevent the nut 120 from being removed. There may also be a hole 124 and a protrusion 126 on the lengths. By ensuring that the hole 124 receives the protrusion 126 when the nut 120 is tightened, the lengths 116 and 118 will be properly oriented along each other. As the nut 120 is tightened, the lengths 116 and 118 are held close together, and the ground cover that is between the lengths will be secured. Different ways of improving the hold exist, such as the teeth 130 that are shown along the insides 128 and 129 of the lengths 116 and 118, respectively. Another option may involve ridges 502 and 504 that are staggered along the insides 128 and 129 of lengths 116 and 118, as shown in FIGS. 5*a* and 5*b*. In these figures, the lengths 118 and 116 are shown removed from the shaft 102, although the hole 502 for receiving the shaft 102 is depicted. These options are not meant as an exhaustive list, as there are other methods in the art of increasing the hold on object.

Figure 4:
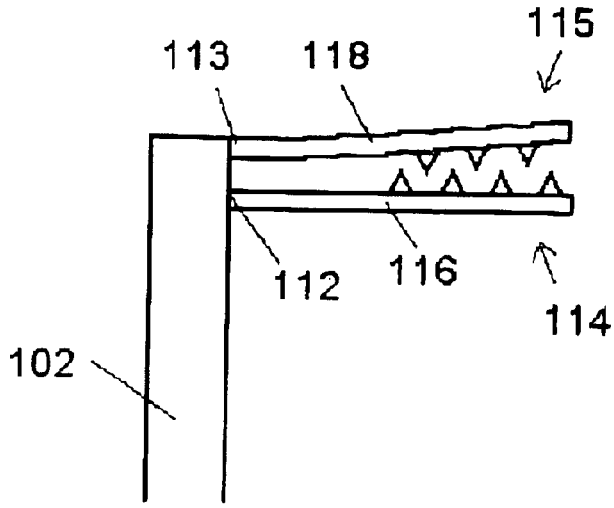
FIG. 4 depicts a means of securing a ground cover.

Referring to FIG. 4, another method of securing the ground cover is shown using elastic clamping means. Upper and lower lengths 118 and 116 are attached to the shaft 102 and held together by elastic properties of the lengths themselves or by spring loading by suitable springs (not shown). These lengths are shown slightly separated, which would be done by an external force (not shown), such that the ground cover may be inserted, and when the lengths 116, 118 are released, the lengths 116 and 118 will secure the ground cover.

The ground cover anchor 100 may be constructed of plastic by using a mold. If this method of construction is used, the lower length 116 in FIG. 1 may be formed directly onto the shaft. It is preferable to have the ground cover anchor brightly colored so as to be easily located.

Figure 6:
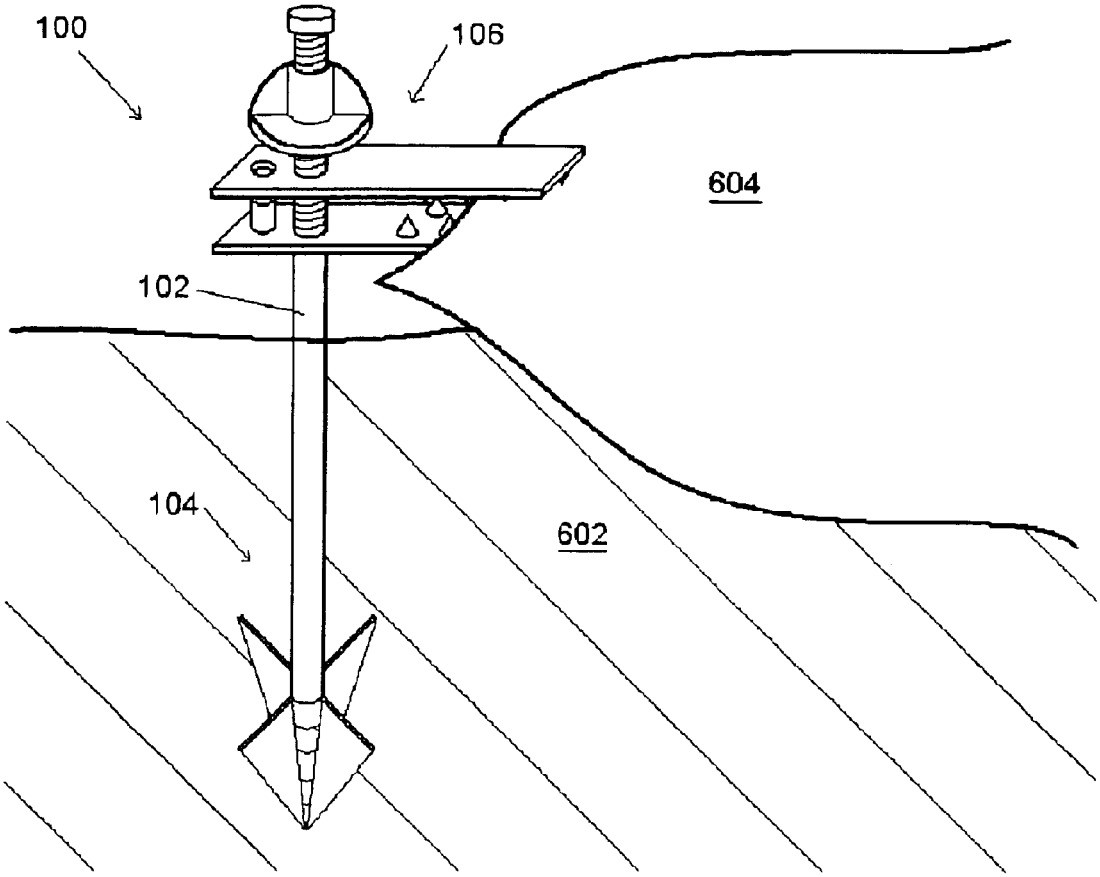
FIG. 6 depicts the ground cover anchor inserted into the ground and securing a ground cover.

The use of the ground cover anchor 100 will now be discussed with reference to FIG. 6. The one end of the shaft 104 for inserting into the ground, which may comprise barbs 110, an inverted cone 202, a spiral 302 along the shaft, or other securing means, is inserted into the ground 602. If a spiral 302 is used, the end 104 of the shaft 102 must be screwed into the ground 602. The clamp 106 at the other end of the shaft 105 is used to secure the ground cover 604. This method is convenient for securing, for example, beach towels on sand or picnic blankets to dirt or grass. This may repeated for each corner of the ground cover, as required. The clamp 106 secures the ground cover 604 by holding it between two lengths 116 and 118 oriented perpendicular to the shaft 102, the lengths being attached to the shaft at one end 112 and 113, and the other ends 128 and 129 being disposed to receive and secure the ground cover. The lengths 116 and 118 may comprise teeth 180, staggered ridges 502 and 504 along the inside 128 and 129 of each length 116 and 118, or other strategies to increase the hold on the ground cover 604. The lengths 116 and 118 may be held together by a nut 120, such as a wingnut, or by elastic properties of the lengths, where the lengths are opened, the ground cover inserted between them, and the lengths are released to apply pressure to the ground cover.

In an alternative embodiment, the clamp may be made with the lower part of the clamp movable, and the upper part fixed. However, this embodiment makes it harder to fix a mat or towel when the peg is placed in the ground. In variations of this embodiment, the lower length may slide on the shaft, or may pivot with an arm extending at right angles from the lower length that pivots with the lower length from a position away from the shaft (jaw open) to a position in which the arm is against the shaft (jaw closed). In a still further embodiment, the clamp may be formed of telescoping members, an upper member having a shaft that extends down into a bore in the shaft of the peg and the peg constituting a lower member. Various methods may be used to secure the telescoping members such as a screw or twist and lock mechanism. In this example, the upper length may be an arm extending perpendicularly from the shaft or may be a disc that sits atop the shaft. In the example where the upper length is a disc, the lower length of the clamp may also be a disc. The use of clamping discs allows a mat or towel to be connected on all sides of the peg.

Immaterial modifications may be made to the embodiments described here without departing from the invention. The word "comprising" used in the claims is used in its exclusive sense and does not preclude other elements being present. The indefinite article "a" used in the claims before an element means that at least one and possibly more than one instance of the element is present.

What is claimed is:

1. A ground cover anchor for anchoring a ground cover, comprising:

a shaft having threads at one end and a point at the other end for inserting into the ground;

a nut threaded onto the shaft;

a bottom length extending perpendicularly from the shaft and fixed to the shaft below the threads;

a top length extending perpendicularly from the shaft and movable between the nut and the bottom length; and the bottom and top lengths each having an end for receiving a ground cover, the ground cover being secured when the ends come together by moving the nut down the shaft.

2. The ground cover anchor of claim 1 in which the shaft comprises a smooth surface between the point and the bottom length, the surface being suitable for printing on.

3. The ground cover anchor of claim 1 in which the point of the shaft comprises barbs.

4. The ground cover anchor of claim 1 in which the point of the shaft comprises an inverted cone.

5. The ground cover anchor of claim 1 in which the point of the shaft comprises a spiral, the spiral being suitable for screwing into the ground.

6. The ground cover anchor of claim 1 in which the ground cover is a towel.

7. The ground cover anchor of claim 6 in which the anchor is inserted into sand.

8. The ground cover anchor of claim 1 in which the ground cover is a picnic blanket.

9. The ground cover anchor of claim 1 in which the ends of the lengths comprise teeth.

10. The ground cover anchor of claim 1 in which the ends of the legs each have a series of ridges, the series of ridges on one length being staggered in relation to the series of ridges on the other length.

11. The ground cover of claim 1 in which one of the top and bottom lengths further comprises a protrusion and the other of the top and bottom lengths further comprises a hole for receiving the protrusion such that when the hole receives the protrusion, the lengths are oriented along each other.

12. The ground cover of claim 1 which the nut is a wingnut.

13. The ground cover of claim 1 in which the nut is a knurled thumb nut.

14. The ground cover of claim 1 in which a stop is attached above the threads at one end of the shaft such that the nut cannot be removed from the shaft.

15. The ground cover anchor of claim 1 in which the ground cover anchor is plastic.

16. The ground cover anchor of claim 1 in which the ground cover anchor is brightly coloured so as to be easily located.

* * * * *